US009771138B2

(12) United States Patent
Ito

(10) Patent No.: US 9,771,138 B2
(45) Date of Patent: Sep. 26, 2017

(54) BOAT MANEUVERING CONTROL METHOD FOR BOAT AND BOAT MANEUVERING CONTROL SYSTEM FOR BOAT

(71) Applicant: YAMAHA HATSUDOKI KABUSHIKI KAISHA, Iwata-shi, Shizuoka (JP)

(72) Inventor: Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/193,211

(22) Filed: Jun. 27, 2016

(65) Prior Publication Data

US 2017/0137103 A1 May 18, 2017

(30) Foreign Application Priority Data

Nov. 17, 2015 (JP) ..... 2015-224671

(51) Int. Cl.
*B63H 21/21* (2006.01)
*B63H 21/12* (2006.01)
*B63H 20/00* (2006.01)

(52) U.S. Cl.
CPC ..... *B63H 21/21* (2013.01); *B63H 20/00* (2013.01); *B63H 21/12* (2013.01)

(58) Field of Classification Search
CPC ..... B63H 21/21; B63H 21/12; B63H 20/00
See application file for complete search history.

(56) References Cited

U.S. PATENT DOCUMENTS

| | | | | |
|---|---|---|---|---|
| 7,214,110 | B1 | 5/2007 | Ehlers et al. | |
| 7,361,067 | B1 | 4/2008 | Smedema | |
| 7,877,174 | B2 * | 1/2011 | Walser | B63B 49/00 440/1 |
| 9,233,744 | B2 * | 1/2016 | Clever | B63H 21/21 |

FOREIGN PATENT DOCUMENTS

JP 2015-116847 A 6/2015

* cited by examiner

*Primary Examiner* — Stephen P Avila
(74) *Attorney, Agent, or Firm* — Keating and Bennett, LLP

(57) ABSTRACT

A boat maneuvering control method for a boat includes setting a target boat speed, detecting an actual boat speed of the boat, and acquiring a base engine rotational speed associated with the target boat speed that is set, correcting the base engine rotational speed according to a difference between the target boat speed and the actual boat speed so as to set the base engine rotational speed that is corrected as a target engine rotational speed, and controlling an engine based on the target engine rotational speed that is set such that the actual boat speed approaches the target boat speed.

19 Claims, 4 Drawing Sheets

FIG.6 TARGET BOAT SPEED CONTROL PROCESSING
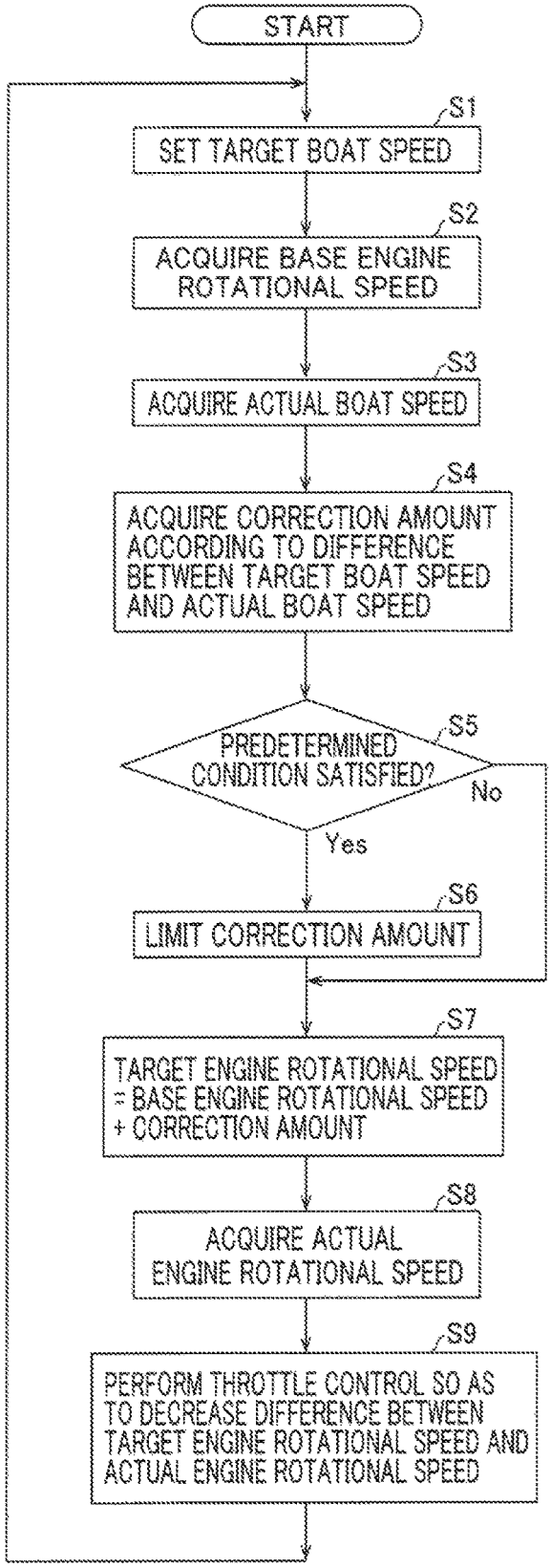

BOAT MANEUVERING CONTROL METHOD FOR BOAT AND BOAT MANEUVERING CONTROL SYSTEM FOR BOAT

CROSS-REFERENCE TO RELATED APPLICATION

This application claims priority to Patent Application No. 2015-224671 filed in Japan on Nov. 17, 2015, the entire contents of which are hereby incorporated by reference.

BACKGROUND OF THE INVENTION

1. Field of the Invention

The present invention relates to a boat maneuvering control method for a boat and a boat maneuvering control system for a boat.

2. Description of the Related Art

A boat maneuvering control system for a boat is known in general. Such a boat maneuvering control system for a boat is disclosed in U.S. Pat. No. 7,214,110 and U.S. Pat. No. 7,361,067.

U.S. Pat. No. 7,214,110 discloses a boat maneuvering control system for a boat including an engine, a throttle mechanism that manipulates the output of the engine, and a microprocessor that controls the acceleration of the boat. The microprocessor of the boat maneuvering control system for a boat prepares an acceleration profile as a function of time by setting a target rotational speed, an acceleration rate, an overshoot rate, and an overshoot period and controls the rotational speed of the engine based on the prepared acceleration profile.

U.S. Pat. No. 7,361,067 discloses a boat maneuvering control system for a boat including an engine, a throttle device that manipulates the output of the engine, and a microprocessor that controls the acceleration of the boat. The microprocessor of the boat maneuvering control system for a boat learns and stores an actual acceleration profile of the boat and controls the rotational speed of the engine based on the stored acceleration profile.

In the control system for a boat described in each of U.S. Pat. No. 7,214,110 and U.S. Pat. No. 7,361,067, the engine (the rotational speed of the engine) is controlled based on the acceleration profile. When the engine is controlled by feedback control in a state where a target boat speed is set, however, it may take time for an actual boat speed to approach the target boat speed due to a delay in determining the actual boat speed of the boat with respect to a change in engine rotational speed or the like. In this case, responsiveness is disadvantageously poor. When a control gain is set high in order to improve responsiveness, an overshoot and hunting occur, and hence convergence is disadvantageously poor. Consequently, when the engine is controlled in the state where the target boat speed is set, it is difficult to achieve both responsiveness and convergence.

SUMMARY OF THE INVENTION

Preferred embodiments of the present invention provide a boat maneuvering control method for a boat and a boat maneuvering control system for a boat that easily achieve both responsiveness and convergence even when an engine is controlled in a state where a target boat speed is set.

A boat maneuvering control method for a boat provided with an engine according to a preferred embodiment of the present invention includes setting a target boat speed, detecting an actual boat speed of the boat, acquiring a base engine rotational speed associated with the target boat speed that is set, correcting the base engine rotational speed according to a difference between the target boat speed and the actual boat speed so as to set the base engine rotational speed that is corrected as a target engine rotational speed, and controlling the engine based on the target engine rotational speed that is set such that the actual boat speed approaches the target boat speed.

The boat maneuvering control method for a boat according to a preferred embodiment of the present invention includes correcting the base engine rotational speed according to the difference between the target boat speed and the actual boat speed so as to set the base engine rotational speed that is corrected as the target engine rotational speed and controlling the engine based on the target engine rotational speed that is set such that the actual boat speed approaches the target boat speed. Thus, the engine rotational speed is quickly increased as compared with the case of performing feedback control so as to set the target engine rotational speed based on only the difference between the target boat speed and the actual boat speed, and hence the time required for the actual boat speed to approach the target boat speed is reduced, and responsiveness is improved. A control gain may not be set high in order to improve responsiveness, and hence the actual boat speed easily substantially converges on the target boat speed, and convergence is improved. Consequently, both responsiveness and convergence are easily achieved even when the engine is controlled in a state where the target boat speed is set.

In the boat maneuvering control method according to a preferred embodiment of the present invention, the base engine rotational speed associated with the target boat speed is preferably acquired from a map in which the target boat speed and the base engine rotational speed are associated with each other. Accordingly, the base engine rotational speed is acquired from the map, and hence the processing load to acquire the base engine rotational speed is reduced as compared with the case where complex arithmetic operations are performed to acquire the base engine rotational speed.

In this case, the map is preferably updatable. Accordingly, the map is updated such that the accuracy of the map is improved. Consequently, both responsiveness and convergence are more easily achieved.

The method in which the map is updatable preferably further includes acquiring an actual engine rotational speed, and the map is preferably updated based on the actual boat speed and the actual engine rotational speed. Accordingly, a relationship between the actual boat speed of the boat and the actual engine rotational speed is learned and the map is updated. Consequently, the actual usage of the boat is reflected in the map, and hence the accuracy of the map is improved in the actual usage of the boat. Thus, both responsiveness and convergence are more easily achieved. In the boat, a relationship between the boat speed and the engine rotational speed is changed due to unique characteristics of the boat, a change in the weight of the boat, or the like, and hence it is particularly effective that the relationship between the actual boat speed of the boat and the actual engine rotational speed is learned by the map and is updated.

In this case, in a case where the target boat speed remains unchanged for a certain period of time and the actual boat speed substantially converges on the target boat speed, the map is preferably updated based on the actual boat speed and the actual engine rotational speed in this case. Accordingly, the map is updated based on the actual boat speed and the actual engine rotational speed in a steady travel state, and hence the accuracy of the map is further improved.

In the boat maneuvering control method according to a preferred embodiment of the present invention, the target engine rotational speed is preferably acquired by performing a correction to increase or decrease the base engine rotational speed according to the difference between the target boat speed and the actual boat speed. Accordingly, the base engine rotational speed is easily corrected, and hence the target engine rotational speed is easily acquired.

In the boat maneuvering control method according to a preferred embodiment of the present invention, correction of the base engine rotational speed is preferably limited when a predetermined condition is not satisfied. Accordingly, excessive correction of the base engine rotational speed is significantly reduced or prevented when the predetermined condition is not satisfied, and hence decreases in responsiveness and convergence are significantly reduced or prevented.

In this case, a correction amount to correct the base engine rotational speed is preferably acquired according to the difference between the target boat speed and the actual boat speed, the correction amount is preferably limited and the base engine rotational speed is preferably corrected by adding the correction amount after limitation to the base engine rotational speed when the predetermined condition is not satisfied, and the base engine rotational speed is preferably corrected by adding the correction amount to the base engine rotational speed without limiting the correction amount when the predetermined condition is satisfied. Accordingly, the excessive correction of the base engine rotational speed is significantly reduced or prevented when the predetermined condition is not satisfied, and the base engine rotational speed is properly corrected when the predetermined condition is satisfied.

In the method in which the correction amount is acquired, the correction amount is preferably limited by setting an upper limit and a lower limit for the correction amount. Accordingly, the correction amount is limited to be a value between the upper limit and the lower limit, and hence the excessive correction of the base engine rotational speed is easily significantly reduced or prevented.

In the method in which the correction of the base engine rotational speed is limited when the predetermined condition is not satisfied, the predetermined condition preferably includes at least one of a condition that the actual boat speed reaches a predetermined boat speed, a condition that the actual engine rotational speed of the engine reaches a predetermined engine rotational speed, a condition that the difference between the target boat speed and the actual boat speed reaches a predetermined value, and a condition that a predetermined time elapses after control of the engine is started. Accordingly, it is easily determined whether or not the predetermined condition is satisfied based on the conditions described above.

In the boat maneuvering control method according to a preferred embodiment of the present invention, the engine is preferably controlled by controlling a throttle of the engine. Accordingly, the output of the engine is easily controlled.

In the boat maneuvering control method according to a preferred embodiment of the present invention, the base engine rotational speed associated with the target boat speed that is set is preferably acquired, the base engine rotational speed is preferably corrected according to the difference between the target boat speed and the actual boat speed so as to set the base engine rotational speed that is corrected as the target engine rotational speed, and the engine is preferably controlled based on the target engine rotational speed that is set such that the actual boat speed approaches the target boat speed, when an instruction to start target boat speed control is received. Accordingly, the target boat speed control in which both responsiveness and convergence are easily achieved is performed when a user wishes to start the target boat speed control.

In this case, the base engine rotational speed associated with the target boat speed that is set is preferably acquired, the base engine rotational speed is preferably corrected according to the difference between the target boat speed and the actual boat speed so as to set the base engine rotational speed that is corrected as the target engine rotational speed, and the engine is preferably controlled based on the target engine rotational speed that is set, when an instruction to start an acceleration mode of accelerating the boat is received. Accordingly, the target boat speed control in which both responsiveness and convergence are easily achieved is performed in the acceleration mode. Consequently, occurrence of an overshoot and hunting is significantly reduced or prevented when water skis, a wakeboard, or the like is towed in the acceleration mode, for example, and hence looseness of the tension of a rope for towing is significantly reduced or prevented.

A boat maneuvering control system for a boat according to a preferred embodiment of the present invention includes an engine, a speed controller that sets a target boat speed, a boat speed detector that detects the actual boat speed of the boat, a storage that stores a base engine rotational speed associated with the target boat speed, and a controller that acquires, from the storage, the base engine rotational speed associated with the target boat speed that is set, corrects the base engine rotational speed according to a difference between the target boat speed and the actual boat speed so as to set the base engine rotational speed that is corrected as a target engine rotational speed, and controls the engine based on the target engine rotational speed that is set.

The boat maneuvering control system for a boat according to a preferred embodiment of the present invention is provided with the controller that corrects the base engine rotational speed according to the difference between the target boat speed and the actual boat speed so as to set the base engine rotational speed that is corrected as the target engine rotational speed and controls the engine based on the target engine rotational speed that is set. Thus, both responsiveness and convergence are easily achieved even when the engine is controlled in a state where the target boat speed is set, similarly to the case of the boat maneuvering control method for a boat according to the above preferred embodiment of the present invention.

In the boat maneuvering control system according to a preferred embodiment of the present invention, the storage preferably stores a map in which the target boat speed and the base engine rotational speed are associated with each other, and the controller preferably acquires the base engine rotational speed associated with the target boat speed from the map in which the target boat speed and the base engine rotational speed are associated with each other. Accordingly, the base engine rotational speed is acquired from the map, and hence the processing load to acquire the base engine rotational speed is reduced as compared with the case where arithmetic operations are performed to acquire the base engine rotational speed.

In this case, the controller preferably acquires an actual engine rotational speed and updates the map based on the actual boat speed and the actual engine rotational speed. Accordingly, a relationship between the actual boat speed of the boat and the actual engine rotational speed is learned and the map is updated. Consequently, the actual usage of the boat is reflected in the map, and hence the accuracy of the map is improved in the actual usage of the boat. Thus, both responsiveness and convergence are more easily achieved. In the boat, a relationship between the boat speed and the engine rotational speed is changed due to unique characteristics of the boat, a change in the weight of the boat, or the like, and hence it is particularly effective that the relationship between the actual boat speed of the boat and the actual engine rotational speed is learned by the map and is updated.

In the structure in which the map is updated, in a case where the target boat speed remains unchanged for a certain period of time and the actual boat speed substantially converges on the target boat speed, the controller preferably updates the map based on the actual boat speed and the actual engine rotational speed in this case. Accordingly, the map is updated based on the actual boat speed and the actual engine rotational speed in a steady travel state, and hence the accuracy of the map is further improved.

In the boat maneuvering control system according to a preferred embodiment of the present invention, the controller preferably limits correction of the base engine rotational speed when a predetermined condition is not satisfied. Accordingly, excessive correction of the base engine rotational speed is significantly reduced or prevented when the predetermined condition is not satisfied, and hence decreases in responsiveness and convergence are significantly reduced or prevented.

The boat maneuvering control system according to a preferred embodiment of the present invention preferably further includes an instruction input that receives an instruction to start target boat speed control, and the controller preferably acquires the base engine rotational speed associated with the target boat speed that is set, corrects the base engine rotational speed according to the difference between the target boat speed and the actual boat speed so as to set the base engine rotational speed that is corrected as the target engine rotational speed, and controls the engine based on the target engine rotational speed that is set such that the actual boat speed approaches the target boat speed, when the instruction input receives the instruction to start the target boat speed control. Accordingly, the boat speed of the boat is controlled while both responsiveness and convergence are achieved when a user wishes to start the target boat speed control.

In this case, the controller preferably acquires the base engine rotational speed associated with the target boat speed that is set, corrects the base engine rotational speed according to the difference between the target boat speed and the actual boat speed so as to set the base engine rotational speed that is corrected as the target engine rotational speed, and controls the engine based on the target engine rotational speed that is set, when the instruction input receives an instruction to start an acceleration mode of accelerating the boat. Accordingly, the target boat speed control in which both responsiveness and convergence are easily achieved is performed in the acceleration mode. Consequently, occurrence of an overshoot and hunting is significantly reduced or prevented when water skis, a wakeboard, or the like is towed in the acceleration mode, for example, and hence looseness of the tension of a rope for towing is significantly reduced or prevented.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 6 is a flowchart for illustrating target boat speed control processing in the boat maneuvering control system for a boat according to a preferred embodiment of the present invention.

DETAILED DESCRIPTION OF THE PREFERRED EMBODIMENTS

Preferred embodiments of the present invention are hereinafter described with reference to the drawings.

The structure of a boat 1 including a boat maneuvering control system 100 for a boat according to preferred embodiments of the present invention is now described with reference to FIGS. 1 and 2. In the figures, arrow FWD represents the forward movement direction of the boat 1, and arrow BWD represents the backward movement direction of the boat 1. In the figures, arrow R represents the starboard direction of the boat 1, and arrow L represents the portside direction of the boat 1.

Figure 1:
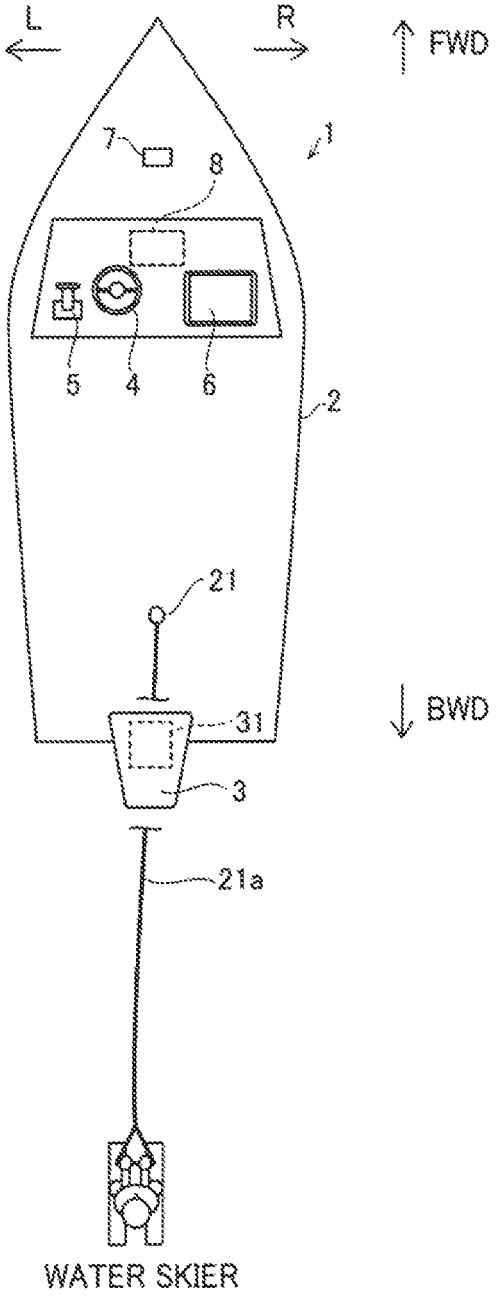
FIG. 1 is a diagram showing a boat including a boat maneuvering control system for a boat according to a preferred embodiment of the present invention.
Figure 2:
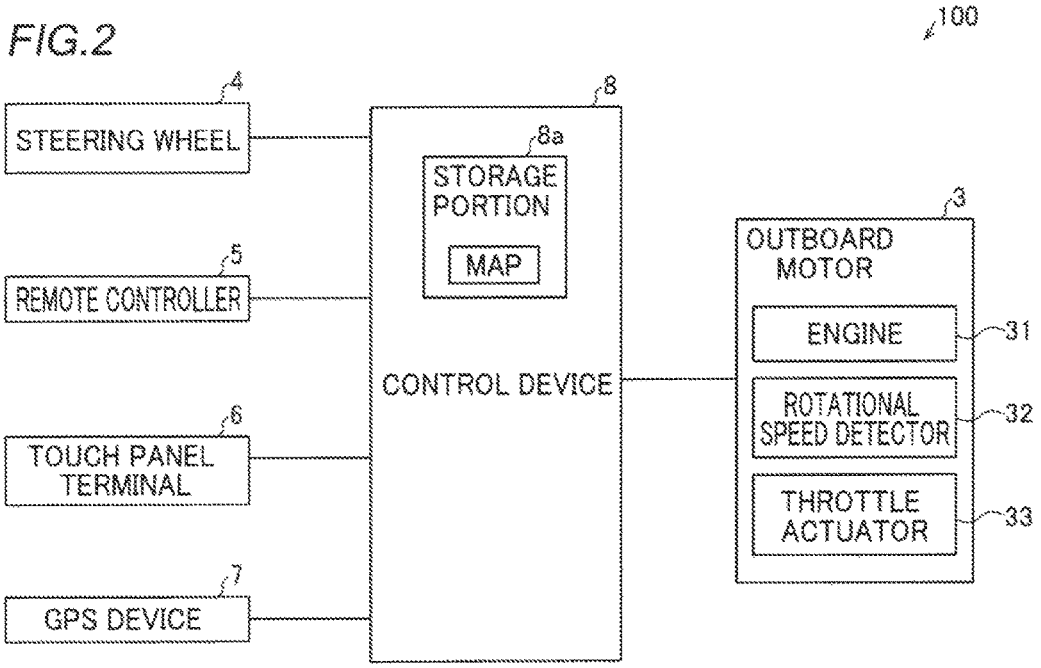
FIG. 2 is a block diagram schematically showing the boat maneuvering control system for a boat according to a preferred embodiment of the present invention.

The boat 1 includes a boat body 2, a single outboard motor 3, a steering wheel 4, a remote controller 5, a touch panel terminal 6, a GPS (global positioning system) device 7, and a controller 8, as shown in FIGS. 1 and 2. The touch panel terminal 6 is an example of an "instruction input". The GPS device 7 is an example of a "boat speed detector". The controller 8 is an example of a "speed controller" or a "controller".

As shown in FIG. 1, the boat body 2 is provided with a towing rope mounting portion 21. A first end of a towing rope 21*a* is mounted on the towing rope mounting portion 21 of the boat body 2. A second end of the towing rope 21*a* is grasped by a water skier (a person who skis on water), a wakeboarder (a person who does wakeboarding), or the like. In other words, the boat 1 is a boat capable of towing water skis, a wakeboard, or the like.

As shown in FIGS. 1 and 2, the outboard motor 3 is a propulsion device that provides thrust force to the boat body 2. The outboard motor 3 is mounted on a rear portion of the boat body 2. The outboard motor 3 includes an engine 31 as a power source that provides a thrust force to the boat body 2. The outboard motor 3 includes a drive shaft (not shown) extending to below the engine 31, one propeller shaft (not shown) that extends in a direction perpendicular or substantially perpendicular to (intersecting with) the drive shaft, and one propeller (not shown) mounted on a rear end portion of the propeller shaft, rotated together with the propeller shaft. In the outboard motor 3, a drive force generated by the engine 31 is transmitted to the propeller through the drive shaft and the propeller shaft. Thus, the propeller is rotated such that the outboard motor 3 provides a thrust force to the boat body 2.

The outboard motor 3 includes a rotational speed detector 32 that detects the rotational speed of the engine 31 and a throttle actuator 33 that changes the position of a throttle of the engine 31. The engine 31 changes its rotational speed according to the position of the throttle changed by the throttle actuator 33. The rotational speed of the engine 31 (hereinafter referred to as the "engine rotational speed") detected by the rotational speed detector 32 is acquired by the controller 8.

The steering wheel 4 steers the boat body 2. The steering wheel 4 is connected to a turning device (not shown) through the controller 8. The turning device turns the outboard motor 3 based on operation of the steering wheel 4 such that the boat body 2 is steered.

The remote controller 5 manipulates the shift and output (the position of the throttle) of the outboard motor 3. The remote controller 5 is connected to the outboard motor 3 through the controller 8. The output and shift (forward movement, reverse movement, or neutral) of the outboard motor 3 are controlled based on operation of the remote controller 5.

The touch panel terminal 6 is used to manipulate movement of the boat body 2 and to select and switch a mode of the operating state of the boat 1. Specifically, the touch panel terminal 6 controls the outboard motor 3 to manipulate movement of the boat 1. The touch panel terminal 6 is portable, and a user maneuvers the boat 1 in an arbitrary location on the boat 1 with the touch panel terminal 6 in his/her hand. The touch panel terminal 6 is a tablet terminal, for example.

The touch panel terminal 6 displays information about the boat 1. The touch panel terminal 6 displays information such as the boat speed of the boat 1, the rotational speed of the engine 31, the remaining amount and consumed amount of fuel (gasoline), the fuel efficiency, the temperature of the engine 31, the capacity of a battery, the mode of the operating state, etc., for example. The touch panel terminal 6 receives selection of the mode of the operating state by the user. The mode of the operating state includes an auto cruise mode of automatically maneuvering the boat 1, a mode of docking the boat 1 and moving the boat 1 away from the shore when docking the boat 1 and moving the boat 1 away from the shore, a trolling mode of sailing the boat 1 at low speed, and an acceleration mode (towing mode) of towing water skis, a wakeboard, or the like. The touch panel terminal 6 is in wired or wireless communication with the controller 8.

The GPS device 7 detects the position and speed (boat speed) of the boat 1. The position and boat speed of the boat 1 detected by the GPS device 7 are acquired by the controller 8.

The controller 8 controls the outboard motor 3 etc. based on information from the outboard motor 3, the steering wheel 4, the remote controller 5, the touch panel terminal 6, the GPS device 7, etc.

The controller 8 is provided with a storage 8*a*. The storage 8*a* stores a map in which in the steady travel state of the boat 1, the boat speed and the engine rotational speed are associated with each other.

Figure 3:
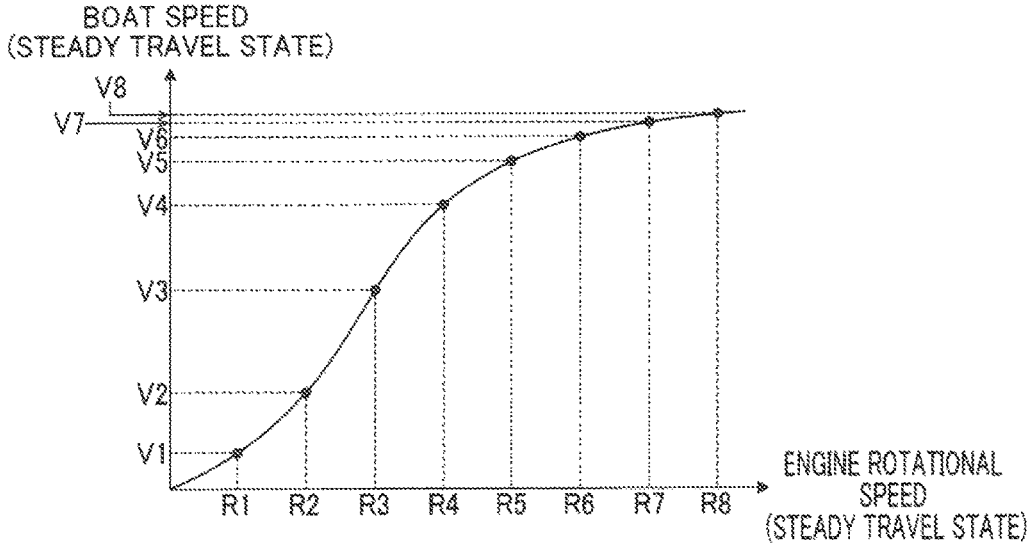
FIG. 3 illustrates an example of a relationship between a boat speed and an engine rotational speed in the steady travel state of the boat according to a preferred embodiment of the present invention.

FIG. 3 shows an example of a relationship between the boat speed and the engine rotational speed in the steady travel state of the boat 1. The storage 8*a* stores the map in which the boat speeds V1 to V8 in the steady travel state are associated with the engine rotational speeds R1 to R8 in the cases of the boat speeds V1 to V8, respectively, for example. Eight sets of associated values shown in FIG. 3 are merely exemplary, and the map may include one set or two or more sets of associated values other than the eight sets of associated values.

The boat maneuvering control system 100 for a boat includes the outboard motor 3, the steering wheel 4, the remote controller 5, the touch panel terminal 6, the GPS device 7, the controller 8, and the storage 8*a*, as shown in FIG. 2. Target boat speed control for the boat 1 performed by the boat maneuvering control system 100 for a boat is now described.

According to a preferred embodiment, the controller 8 starts the target boat speed control when receiving an instruction to start the target boat speed control through the touch panel terminal 6. Specifically, the controller 8 starts the target boat speed control when receiving an instruction to start the acceleration mode (towing mode) of accelerating the boat 1 through the touch panel terminal 6.

Figure 4:
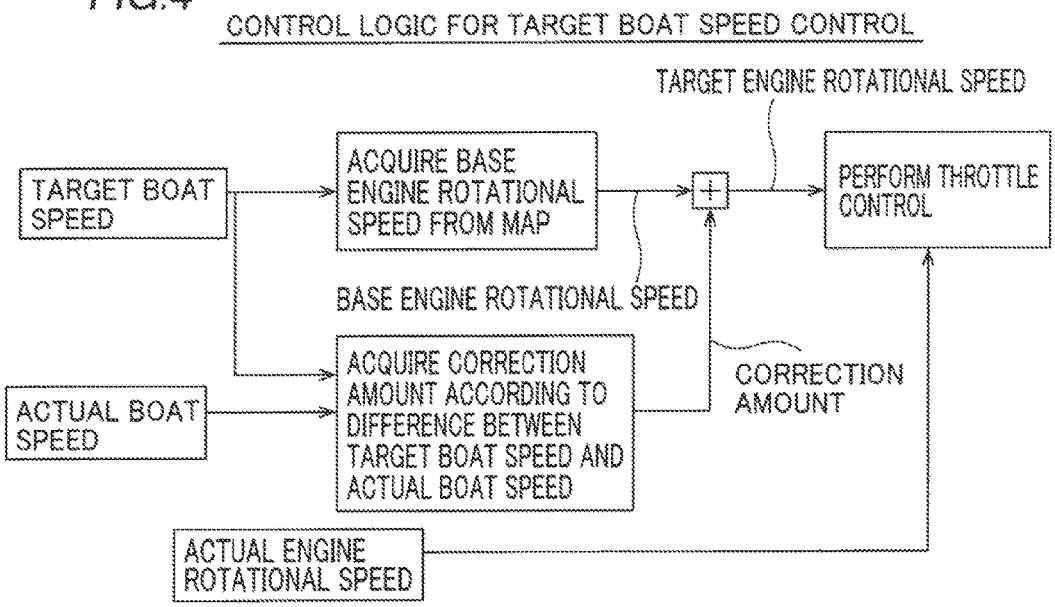
FIG. 4 illustrates control logic for target boat speed control in the boat maneuvering control system for a boat according to a preferred embodiment of the present invention.

According to a preferred embodiment, the controller 8 sets a target boat speed, as shown in FIG. 4. The controller 8 acquires an engine rotational speed (hereinafter referred to as the "base engine rotational speed") associated with the set target boat speed from the storage 8*a*.

The controller 8 corrects the base engine rotational speed according to a difference between the target boat speed and the actual speed of the boat 1 (hereinafter referred to as the "actual boat speed") so as to set the corrected base engine rotational speed as a target engine rotational speed. The controller 8 controls the engine 31 of the outboard motor 3 based on the set target engine rotational speed such that the actual boat speed approaches the target boat speed. At this time, the controller 8 controls the engine 31 by controlling the throttle of the engine 31 by the throttle actuator 33 of the outboard motor 3. In this manner, the boat maneuvering control system 100 of the boat 1 performs the target boat speed control.

Control logic for the target boat speed control is now described with reference to FIG. 4.

Figure 5:
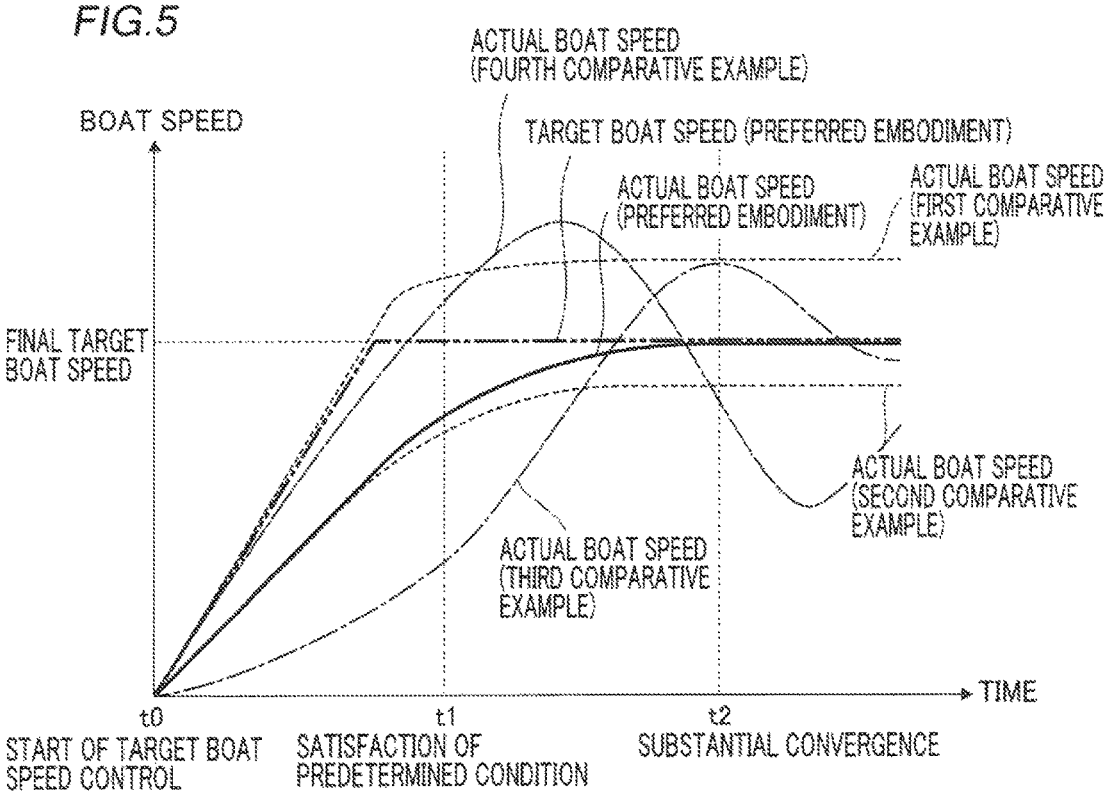
FIG. 5 illustrates an example of a relationship between a target boat speed, an actual boat speed, and time in the target boat speed control performed by the boat maneuvering control system for a boat according to a preferred embodiment of the present invention.

In the target boat speed control, the controller 8 first acquires and sets the target boat speed, as shown in FIG. 4. The target boat speed may be a fixed value (final target boat speed, for example) or a variable value that varies until reaching the final target boat speed, as shown in FIG. 5. The final target boat speed is specified by the user with the touch panel terminal 6, for example. The boat maneuvering control system 100 of the boat 1 performs the target boat speed control such that the actual boat speed approaches the final target boat speed.

The controller 8 acquires the base engine rotational speed associated with the set target boat speed from the map in the storage 8*a*. When the set target boat speed is V1 shown in FIG. 3, for example, R1 shown in FIG. 3 is acquired as the base engine rotational speed from the storage 8*a*.

The controller 8 acquires the actual boat speed of the boat 1 detected by the GPS device 7. The controller 8 acquires and sets the target engine rotational speed by performing a correction to increase or decrease the base engine rotational speed according to the difference between the target boat speed and the actual boat speed.

Specifically, the controller 8 acquires a correction amount to correct the base engine rotational speed according to the difference between the target boat speed and the actual boat speed. More specifically, the controller 8 acquires the correction amount such that an absolute value of the correction amount is increased as an absolute value of the difference between the target boat speed and the actual boat speed is increased. The controller 8 acquires a positive correction amount when the difference between the target boat speed and the actual boat speed is a positive value. The controller 8 acquires a negative correction amount when the difference between the target boat speed and the actual boat speed is a negative value.

The controller 8 performs a correction to increase or decrease the base engine rotational speed by adding the acquired correction amount to the base engine rotational speed, and acquires and sets the target engine rotational speed.

The controller 8 acquires an actual engine rotational speed detected by the rotational speed detector 32 of the outboard motor 3. The controller 8 controls the throttle of the engine 31 (performs throttle control) by the throttle actuator 33 according to a difference between the target engine rotational speed and the actual engine rotational speed so as to decrease the difference between the target engine rotational speed and the actual engine rotational speed (such that the actual engine rotational speed approaches the target engine rotational speed). The controller 8 performs the target boat speed control for the boat 1 by controlling the throttle of the engine 31 and controlling the rotational speed of the engine 31.

The controller 8 limits correction of the base engine rotational speed during a period from the start of control of the engine 31 in the target boat speed control to the satisfaction of a predetermined condition. Specifically, the controller 8 limits the correction amount by setting an upper limit and a lower limit for the correction amount.

When the predetermined condition is not satisfied (during the period from the start of the control of the engine 31 in the target boat speed control to the satisfaction of the predetermined condition), the controller 8 limits the correction amount and corrects the base engine rotational speed by adding the correction amount after the limitation to the base engine rotational speed. More specifically, the controller 8 adds the upper limit or the lower limit to the base engine rotational speed when the predetermined condition is not satisfied and the correction amount larger than the upper limit or the correction amount smaller than the lower limit is acquired.

When the predetermined condition is satisfied (after predetermined condition is satisfied), on the other hand, the controller 8 corrects the base engine rotational speed by adding the correction amount to the base engine rotational speed without limiting the correction amount. More specifically, the controller 8 directly adds the correction amount acquired according to the target boat speed and the actual boat speed to the base engine rotational speed when the predetermined condition is satisfied.

As the predetermined condition, a condition that the actual boat speed reaches a predetermined boat speed, a condition that the actual engine rotational speed of the engine 31 reaches a predetermined engine rotational speed, a condition that the difference between the target boat speed and the actual boat speed reaches a predetermined value, a condition that a predetermined time elapses after the control of the engine 31 is started, or the like, for example may be used.

The map stored in the storage 8*a* is updatable. The map may be manually updated, for example. The map may also be automatically updated by the boat maneuvering control system 100 of the boat 1, for example.

According to a preferred embodiment, the controller 8 updates the map based on the actual boat speed and the actual engine rotational speed. Specifically, in the case where the target boat speed remains unchanged for a certain period of time and the actual boat speed substantially converges on the target boat speed (in other words, in the case where the boat 1 is considered to be in the steady travel state) in the target boat speed control, the controller 8 updates the map based on the actual boat speed and the actual engine rotational speed in this case. More specifically, the controller 8 updates the map with information obtained by associating the actual boat speed and the actual engine rotational speed in this case with each other. Thus, a relationship between the actual boat speed of the boat 1 and the actual engine rotational speed is learned and reflected in the map.

FIG. 5 shows an example of a relationship between a target boat speed, an actual boat speed, and time in the target boat speed control performed by the boat maneuvering control system 100 of the boat 1. In addition to these, FIG. 5 shows an actual boat speed according to a first comparative example, an actual boat speed according to a second comparative example, an actual boat speed according to a third comparative example, and an actual boat speed according to a fourth comparative example.

In the example shown in FIG. 5, the target boat speed control is started at a time t0. In the example shown in FIG. 5, the target boat speed is gradually increased according to time during a period from the time t0 to a predetermined time and is set to the fixed value (final target boat speed) after the predetermined time.

The first comparative example and the second comparative example each show an example of an actual boat speed in the case of performing the target boat speed control only with feedforward control of controlling an engine rotational speed according to the target boat speed shown in FIG. 5. More specifically, in each of the first comparative example and the second comparative example, processing from acquisition of the base engine rotational speed from the map according to the target boat speed to control of the engine 31 in FIG. 4 is performed. In the feedforward control, influences of external factors such as wind, waves, and tides are not reflected in the target boat speed control. Thus, even when the engine rotational speed is kept at a predetermined rotational speed, the actual boat speed may be kept larger than the final target boat speed as in the first comparative example or may be kept smaller than the final target boat speed as in the second comparative example due to the influences of the external factors such as wind, waves, and tides. Therefore, when the target boat speed control is performed only with the feedforward control of controlling an engine rotational speed, the actual boat speed may not converge on the final target boat speed.

The third comparative example and the fourth comparative example each show an example of an actual boat speed in the case of performing the target boat speed control only with feedback control according to the target boat speed shown in FIG. 5. According to the third comparative example, the actual boat speed gradually converges on the final target boat speed, but it takes time for the actual boat speed to converge on the final target boat speed as compared with the case where the boat maneuvering control system 100 of the boat 1 according to the preferred embodiments of the present invention performs the target boat speed control. Furthermore, according to the third comparative example, an overshoot occurs before the actual boat speed converges on the final target boat speed.

According to the fourth comparative example, a control gain is set higher as compared with the third comparative example. According to the fourth comparative example, the time required for the actual boat speed to reach the final target boat speed is reduced as compared with the third comparative example, but a larger overshoot occurs as compared with the third comparative example. Furthermore, according to the fourth comparative example, hunting is likely to occur. Thus, when the target boat speed control is performed only with the feedback control, it is difficult to achieve both responsiveness and convergence.

On the other hand, the boat maneuvering control system 100 of the boat 1 according to the preferred embodiments of the present invention performs the target boat speed control for the boat 1 by combining the base engine rotational speed (feedforward component) associated with the target boat speed with the correction amount (feedback component) based on the target boat speed and the actual boat speed. Consequently, the actual boat speed promptly substantially converges on the target boat speed (final target boat speed) while occurrence of an overshoot and hunting is significantly reduced or prevented. Thus, both responsiveness and convergence are easily achieved as compared with the case where the target boat speed control is performed only with the feedback control and the case where the target boat speed control is performed only with the feedforward control.

In the example shown in FIG. 5, at a time t1, the predetermined condition is satisfied. At a time t2, the target boat speed remains unchanged for a certain period of time, and the actual boat speed substantially converges on the target boat speed.

In this case, during a period from the time t0 to the time t1, the predetermined condition is not satisfied, and hence the target engine rotational speed is acquired in a state where the correction of the base engine rotational speed is limited, and the engine 31 is controlled based on the target engine rotational speed. Thus, excessive correction of the base engine rotational speed before the time t1 is significantly reduced or prevented, and hence after the time t1, occurrence of an overshoot is more significantly reduced or prevented. After the time t1, the predetermined condition is satisfied, and hence the target engine rotational speed is acquired without limiting the correction of the base engine rotational speed, and the engine 31 is controlled based on the target engine rotational speed. Thus, even when the base engine rotational speed is deviated from an engine rotational speed corresponding to the final target boat speed (as in the first comparative example and the second comparative example), the base engine rotational speed is properly corrected such that the actual boat speed substantially converges on the final target boat speed.

At the time t2, the controller 8 determines that the target boat speed remains unchanged for a certain period of time and the actual boat speed substantially converges on the target boat speed. Then, the controller 8 updates the map stored in the storage 8*a* based on the actual boat speed and the actual engine rotational speed at the time t2.

Target boat speed control processing performed by the boat maneuvering control system 100 of the boat 1 according to the preferred embodiments of the present invention is now described with reference to a flowchart in FIG. 6. The target boat speed control processing is performed by the controller 8.

When the user gives an instruction to start the target boat speed control (for starting the acceleration mode), the controller 8 first acquires and sets the target boat speed at a step S1, as shown in FIG. 6.

At a step S2, the controller 8 acquires the base engine rotational speed associated with the target boat speed set at the step S1 from the map stored in the storage 8*a*.

At a step S3, the controller 8 acquires the actual boat speed detected by the GPS device 7.

At a step S4, the controller 8 acquires the correction amount to correct the base engine rotational speed acquired at the step S2 according to the difference between the target boat speed and the actual boat speed.

At a step S5, the controller 8 determines whether or not the predetermined condition is satisfied. More specifically, the controller 8 determines whether or not the actual boat speed has reached the predetermined boat speed, whether or not the actual engine rotational speed of the engine 31 has reached the predetermined engine rotational speed, whether or not the difference between the target boat speed and the actual boat speed has reached the predetermined value, whether or not the predetermined time has elapsed after the start of the control of the engine 31, or the like. When determining that the predetermined condition is satisfied, the controller 8 advances to a step S6. When determining that the predetermined condition is not satisfied, the controller 8 advances to a step S7.

At the step S6, the controller 8 limits the correction amount acquired at the step S4. Specifically, at the step S6, the controller 8 determines whether the correction amount larger than the upper limit or the correction amount smaller than the lower limit has been acquired at the step S4. When determining that the correction amount larger than the upper limit has been acquired at the step S4, the controller 8 limits the correction amount by setting the correction amount to the upper limit. When determining that the correction amount smaller than the lower limit has been acquired at the step S4, the controller 8 limits the correction amount by setting the correction amount to the lower limit. When determining that the correction amount not more than the upper limit and not less than the lower limit has been acquired at the step S4, the controller 8 directly uses the correction amount acquired at the step S4 without limiting the correction amount. Also when advancing to the step S7 not through the step S6, the controller 8 directly uses the correction amount acquired at the step S4 without limiting the correction amount.

At the step S7, the controller 8 acquires and sets the target engine rotational speed by correcting the base engine rotational speed. Specifically, when limiting the correction amount at the step S6, the controller 8 corrects the base engine rotational speed by adding the correction amount after the limitation to the base engine rotational speed, and acquires and sets the target engine rotational speed. When not limiting the correction amount at the step S6, the controller 8 corrects the base engine rotational speed by directly adding the correction amount acquired at the step S4 to the base engine rotational speed, and acquires and sets the target engine rotational speed.

At a step S8, the controller 8 acquires the actual engine rotational speed detected by the rotational speed detector 32 of the outboard motor 3.

At a step S9, the controller 8 performs throttle control so as to decrease the difference between the target engine rotational speed and the actual engine rotational speed. More specifically, the controller 8 changes the position of the throttle by the throttle actuator 33 so as to decrease the difference between the target engine rotational speed and the actual engine rotational speed. Then, the controller 8 returns to the step S1.

According to various preferred embodiments of the present invention, the following advantageous effects are obtained.

According to a preferred embodiment of the present invention, the controller 8 corrects the base engine rotational speed according to the difference between the target boat speed and the actual boat speed so as to set the corrected base engine rotational speed as the target engine rotational speed and controls the engine 31 based on the set target engine rotational speed such that the actual boat speed approaches the target boat speed. Thus, the engine rotational speed is quickly increased as compared with the case of performing the feedback control so as to set the target engine rotational speed based on only the difference between the target boat speed and the actual boat speed (the third comparative example), and hence the time required for the actual boat speed to approach the target boat speed is reduced, and responsiveness is improved. The control gain may not be set high in order to improve responsiveness, and hence the actual boat speed easily substantially converges on the target boat speed, and convergence is improved. Consequently, both responsiveness and convergence are easily achieved even when the engine 31 is controlled in a state where the target boat speed is set.

According to a preferred embodiment of the present invention, the controller 8 acquires the base engine rotational speed associated with the target boat speed from the map of the storage 8*a* in which the target boat speed and the base engine rotational speed are associated with each other. Thus, the base engine rotational speed is acquired from the map, and hence the processing load on the controller 8 to acquire the base engine rotational speed is reduced as compared with the case where complex arithmetic operations are performed to acquire the base engine rotational speed.

According to a preferred embodiment of the present invention, the map is updatable. Thus, the map is updated such that the accuracy of the map is improved. Consequently, both responsiveness and convergence are more easily achieved.

According to a preferred embodiment of the present invention, the controller 8 acquires the actual engine rotational speed and updates the map based on the actual boat speed and the actual engine rotational speed. Thus, the relationship between the actual boat speed of the boat 1 and the actual engine rotational speed is learned and the map is updated. Consequently, the actual usage of the boat 1 is reflected in the map, and hence the accuracy of the map is improved in the actual usage of the boat 1. Thus, both responsiveness and convergence are more easily achieved. In the boat 1, the relationship between the boat speed and the engine rotational speed is changed due to unique characteristics of the boat 1, a change in the weight of the boat 1, or the like, and hence it is particularly effective that the relationship between the actual boat speed of the boat 1 and the actual engine rotational speed is learned by the map and is updated.

According to a preferred embodiment of the present invention, in the case where the target boat speed remains unchanged for a certain period of time and the actual boat speed substantially converges on the target boat speed, the controller 8 updates the map based on the actual boat speed and the actual engine rotational speed in this case. Thus, the map is updated based on the actual boat speed and the actual engine rotational speed in the steady travel state, and hence the accuracy of the map is further improved.

According to a preferred embodiment of the present invention, the controller 8 acquires the target engine rotational speed by performing a correction to increase or decrease the base engine rotational speed according to the difference between the target boat speed and the actual boat speed. Thus, the base engine rotational speed is easily corrected, and hence the target engine rotational speed is easily acquired.

According to a preferred embodiment of the present invention, the controller 8 limits the correction of the base engine rotational speed when the predetermined condition is not satisfied. Thus, the excessive correction of the base engine rotational speed is significantly reduced or prevented when the predetermined condition is not satisfied, and hence decreases in responsiveness and convergence are significantly reduced or prevented.

According to a preferred embodiment of the present invention, the controller 8 acquires the correction amount to correct the base engine rotational speed according to the difference between the target boat speed and the actual boat speed, limits the correction amount and corrects the base engine rotational speed by adding the correction amount after the limitation to the base engine rotational speed when the predetermined condition is not satisfied, and corrects the base engine rotational speed by adding the correction amount to the base engine rotational speed without limiting the correction amount when the predetermined condition is satisfied. Thus, the excessive correction of the base engine rotational speed is easily significantly reduced or prevented when the predetermined condition is not satisfied, and the base engine rotational speed is properly corrected when the predetermined condition is satisfied.

According to a preferred embodiment of the present invention, the controller 8 limits the correction amount by setting the upper limit and the lower limit for the correction amount. Thus, the correction amount is limited to be a value between the upper limit and the lower limit, and hence the excessive correction of the base engine rotational speed is easily significantly reduced or prevented.

According to a preferred embodiment of the present invention, as the predetermined condition, at least one of the condition that the actual boat speed reaches the predetermined boat speed, the condition that the actual engine rotational speed of the engine 31 reaches the predetermined engine rotational speed, the condition that the difference between the target boat speed and the actual boat speed reaches the predetermined value, and the condition that the predetermined time elapses after the control of the engine 31 is started is used. Thus, it is easily determined whether or not the predetermined condition is satisfied based on the conditions described above.

According to a preferred embodiment of the present invention, the controller 8 controls the engine 31 by controlling the throttle of the engine 31. Thus, the output of the engine 31 is easily controlled.

According to a preferred embodiment of the present invention, the controller 8 acquires the base engine rotational speed associated with the set target boat speed, corrects the base engine rotational speed according to the difference between the target boat speed and the actual boat speed so as to set the corrected base engine rotational speed as the target engine rotational speed, and controls the engine 31 based on the set target engine rotational speed such that the actual boat speed approaches the target boat speed when receiving the instruction to start the target boat speed control. Thus, the target boat speed control in which both responsiveness and convergence are easily achieved is performed when the user wishes to start the target boat speed control.

According to a preferred embodiment of the present invention, the controller 8 acquires the base engine rotational speed associated with the set target boat speed, corrects the base engine rotational speed according to the difference between the target boat speed and the actual boat speed so as to set the corrected base engine rotational speed as the target engine rotational speed, and controls the engine 31 based on the set target engine rotational speed when receiving the instruction to start the acceleration mode of accelerating the boat 1. Thus, the target boat speed control in which both responsiveness and convergence are easily achieved is performed in the acceleration mode. Consequently, the occurrence of an overshoot and hunting is significantly reduced or prevented when water skis, a wakeboard, or the like is towed in the acceleration mode, for example, and hence looseness of the tension of the rope for towing is significantly reduced or prevented.

The preferred embodiments of the present invention described above are illustrative in all points and not restrictive. The extent of the present invention is not defined by the above description of the preferred embodiments but by the scope of claims, and all modifications within the meaning and range equivalent to the scope of claims are further included.

For example, while the speed controller and the controller are preferably integrally provided in the controller in a preferred embodiment described above, the present invention is not restricted to this. According to a preferred embodiment of the present invention, the speed controller and the controller may alternatively be provided separately from each other, or the speed controller and the controller may alternatively be provided in a device other than the controller.

While the outboard motor provided with the engine is preferably used as the propulsion device of the boat in a preferred embodiment described above, the present invention is not restricted to this. According to a preferred embodiment of the present invention, a propulsion device other than the outboard motor may alternatively be used so far as the same is provided with an engine. For example, an inboard motor, a jet propulsion device, an inboard/outboard motor, or the like may alternatively be used as the propulsion device of the boat.

While the single outboard motor (propulsion device) is preferably provided in the boat in a preferred embodiment described above, the present invention is not restricted to this. According to a preferred embodiment of the present invention, two or more propulsion devices may alternatively be provided in the boat.

While the actual boat speed of the boat is preferably detected by the GPS device in a preferred embodiment described above, the present invention is not restricted to this. According to a preferred embodiment of the present invention, the actual boat speed of the boat may alternatively be detected by a device other than the GPS device. For example, the actual boat speed of the boat may be detected from a difference between static pressure and dynamic pressure by a pitot tube, or the actual boat speed of the boat may be detected from the number of rotations of a water wheel by a water wheel device.

While the instruction to start the target boat speed control is preferably received through the touch panel terminal in a preferred embodiment described above, the present invention is not restricted to this. According to a preferred embodiment of the present invention, the instruction to start the target boat speed control may alternatively be received through a device other than the touch panel terminal. The instruction to start the target boat speed control may be received through a device such as a joystick, for example.

While the base engine rotational speed associated with the boat speed (target boat speed) is preferably acquired with the map in a preferred embodiment described above, the present invention is not restricted to this. According to a preferred embodiment of the present invention, the base engine rotational speed associated with the boat speed (target boat speed) may alternatively be acquired with a function (calculation formula).

While the correction amount is preferably limited by setting the upper limit and the lower limit for the correction amount until the predetermined condition is satisfied in a preferred embodiment described above, the present invention is not restricted to this. According to a preferred embodiment of the present invention, the correction amount may alternatively be limited by performing no correction until the predetermined condition is satisfied. In this case, the base engine rotational speed may be directly used as the target engine rotational speed until the predetermined condition is satisfied.

While the target boat speed control is preferably started when the instruction to start the acceleration mode (towing mode) of accelerating the boat is received in a preferred embodiment described above, the present invention is not restricted to this. According to a preferred embodiment of the present invention, the target boat speed control may alternatively be started when an instruction to start a mode other than the acceleration mode is received. The target boat speed control may be started when an instruction to start the auto cruise mode is received, for example.

While the processing operations performed by the controller are described using a flowchart in a flow-driven manner in which processing is performed in order along a processing flow for the convenience of illustration in a preferred embodiment described above, the present invention is not restricted to this. According to a preferred embodiment of the present invention, the processing operations performed by the controller may alternatively be performed in an event-driven manner in which processing is performed on an event basis. In this case, the processing operations performed by the controller may be performed in a complete event-driven manner or in a combination of an event-driven manner and a flow-driven manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat maneuvering control method for a boat provided with an engine, the boat maneuvering control method comprising:

setting a target boat speed;

detecting an actual boat speed of the boat; and acquiring a base engine rotational speed associated with the target boat speed that is set, correcting the base engine rotational speed according to a difference between the target boat speed and the actual boat speed so as to set the base engine rotational speed that is corrected as a target engine rotational speed, and controlling the engine based on the target engine rotational speed that is set such that the actual boat speed approaches the target boat speed; wherein the target engine rotational speed is acquired by performing a correction to increase or decrease the base engine rotational speed according to the difference between the target boat speed and the actual boat speed.

2. The boat maneuvering control method according to claim 1, wherein the base engine rotational speed associated with the target boat speed is acquired from a map in which the target boat speed and the base engine rotational speed are associated with each other.

3. The boat maneuvering control method according to claim 2, wherein the map is updatable.

4. The boat maneuvering control method according to claim 3, further comprising acquiring an actual engine rotational speed, wherein the map is updated based on the actual boat speed and the actual engine rotational speed.

5. The boat maneuvering control method according to claim 4, wherein in a case in which the target boat speed remains unchanged for a certain period of time and the actual boat speed converges or substantially converges on the target boat speed, the map is updated based on the actual boat speed and the actual engine rotational speed.

6. The boat maneuvering control method according to claim 1, wherein the correcting of the base engine rotational speed is limited when a predetermined condition is not satisfied.

7. The boat maneuvering control method according to claim 6, wherein a correction amount to correct the base engine rotational speed is acquired according to the difference between the target boat speed and the actual boat speed;

the correction amount is limited, and the base engine rotational speed is corrected by adding the correction amount after limitation to the base engine rotational speed when the predetermined condition is not satisfied; and the base engine rotational speed is corrected by adding the correction amount to the base engine rotational speed without limiting the correction amount when the predetermined condition is satisfied.

8. The boat maneuvering control method according to claim 7, wherein the correction amount is limited by setting an upper limit and a lower limit for the correction amount.

9. The boat maneuvering control method according to claim 6, wherein the predetermined condition includes at least one of a condition that the actual boat speed reaches a predetermined boat speed, a condition that an actual engine rotational speed of the engine reaches a predetermined engine rotational speed, a condition that the difference between the target boat speed and the actual boat speed reaches a predetermined value, and a condition that a predetermined time elapses after control of the engine is started.

10. The boat maneuvering control method according to claim 1, wherein the engine is controlled by controlling a throttle of the engine.

11. The boat maneuvering control method according to claim 1, wherein the base engine rotational speed associated with the target boat speed that is set is acquired, the base engine rotational speed is corrected according to the difference between the target boat speed and the actual boat speed so as to set the base engine rotational speed that is corrected as the target engine rotational speed, and the engine is controlled based on the target engine rotational speed that is set such that the actual boat speed approaches the target boat speed, when an instruction to start target boat speed control is received.

12. The boat maneuvering control method according to claim 11, wherein the base engine rotational speed associated with the target boat speed that is set is acquired, the base engine rotational speed is corrected according to the difference between the target boat speed and the actual boat speed so as to set the base engine rotational speed that is corrected as the target engine rotational speed, and the engine is controlled based on the target engine rotational speed that is set, when an instruction to start an acceleration mode of accelerating the boat is received.

13. A boat maneuvering control system for a boat, comprising:

an engine;

a speed controller that sets a target boat speed;

a boat speed detector that detects an actual boat speed of the boat;

a storage that stores a base engine rotational speed associated with the target boat speed; and a controller that acquires, from the storage, the base engine rotational speed associated with the target boat speed that is set, corrects the base engine rotational speed according to a difference between the target boat speed and the actual boat speed so as to set the base engine rotational speed that is corrected as a target engine rotational speed, and controls the engine based on the target engine rotational speed that is set; wherein the controller acquires the target engine rotational speed by performing a correction to increase or decrease the base engine rotational speed according to the difference between the target boat speed and the actual boat speed.

14. The boat maneuvering control system according to claim 13, wherein the storage stores a map in which the target boat speed and the base engine rotational speed are associated with each other; and the controller acquires the base engine rotational speed associated with the target boat speed from the map in which the target boat speed and the base engine rotational speed are associated with each other.

15. The boat maneuvering control system according to claim 14, wherein the controller acquires an actual engine rotational speed and updates the map based on the actual boat speed and the actual engine rotational speed.

16. The boat maneuvering control system according to claim 15, wherein in a case in which the target boat speed remains unchanged for a certain period of time and the actual boat speed converges or substantially converges on the target boat speed, the controller updates the map based on the actual boat speed and the actual engine rotational speed.

17. The boat maneuvering control system according to claim 13, wherein the controller limits correction of the base engine rotational speed when a predetermined condition is not satisfied.

18. The boat maneuvering control system according to claim 13, further comprising an instruction input that receives an instruction to start target boat speed control; wherein the controller acquires the base engine rotational speed associated with the target boat speed that is set, corrects the base engine rotational speed according to the difference between the target boat speed and the actual boat speed so as to set the base engine rotational speed that is corrected as the target engine rotational speed, and controls the engine based on the target engine rotational speed that is set such that the actual boat speed approaches the target boat speed, when the instruction input receives the instruction to start the target boat speed control.

19. The boat maneuvering control system according to claim 18, wherein the controller acquires the base engine rotational speed associated with the target boat speed that is set, corrects the base engine rotational speed according to the difference between the target boat speed and the actual boat speed so as to set the base engine rotational speed that is corrected as the target engine rotational speed, and controls the engine based on the target engine rotational speed that is set, when the instruction input receives an instruction to start an acceleration mode of accelerating the boat.

* * * * *